United States Patent [19]

Watanabe

[11] Patent Number: 4,944,019

[45] Date of Patent: Jul. 24, 1990

[54] LOW SOUND REGION REPRODUCING SPEAKER SYSTEM

[75] Inventor: Hiroshi Watanabe, Hachioji, Japan

[73] Assignee: Kabushiki Kaisha Kenwood, Tokyo, Japan

[21] Appl. No.: 317,404

[22] Filed: Mar. 1, 1989

[30] Foreign Application Priority Data

Mar. 1, 1988 [JP] Japan ..... 63-26009[U]

[51] Int. Cl.[5] ..... H04R 1/02

[52] U.S. Cl. ..... 381/90; 381/186; 381/188; 381/205; 181/145; 181/146; 181/199

[58] Field of Search ..... 181/144, 145, 146, 199; 381/24, 88, 89, 90, 188, 205

[56] References Cited

U.S. PATENT DOCUMENTS

| | | | |
|---|---|---|---|
| 2,969,848 | 1/1961 | Farwell | 181/145 |
| 4,326,099 | 4/1982 | Maille | 381/24 |
| 4,437,540 | 3/1984 | Murakami et al. | 181/199 |
| 4,549,631 | 10/1985 | Bose | 181/155 |

FOREIGN PATENT DOCUMENTS

| | | | |
|---|---|---|---|
| 716381 | 8/1965 | Canada | 181/144 |
| 1147983 | 5/1963 | Fed. Rep. of Germany | 381/90 |
| 2609853 | 7/1988 | France | 381/24 |
| 0052694 | 4/1980 | Japan | 381/24 |

*Primary Examiner*—Forester W. Isen

*Attorney, Agent, or Firm*—Sixbey, Friedman, Leedom & Ferguson

[57] ABSTRACT

A low sound region reproducing speaker system comprising a box, a partition separating the internal space of the box into two spatial portions, a pair of speakers attached to the partition wall, and an aperture formed in the side wall of the box through which one of the spatial portions communicates with the external space. Right and left stereophonic channel signals are respectively reproduced through the pair of speakers. Only the low sound region is emitted into the external space. The partition wall has therein a communication hole for communicating the two spatial portions therethrough with each other.

5 Claims, 5 Drawing Sheets

LOW SOUND REGION REPRODUCING SPEAKER SYSTEM

BACKGROUND OF THE INVENTION

1. Field of the Invention

The present invention relates to low sound region reproducing speaker systems, and more particularly to such systems suitable for use in 3D reproducing systems.

2. Prior Art

A conventional known low sound region reproducing system of this type is shown, for example, in FIGS. 5 and 7.

The speaker system of FIG. 5 includes a pair of speakers 13 and 14 provided on a partition wall 12 within a single box 11 to thereby acoustically mix right and left stereophonic channel signals.

The speaker system is constructed so as to mix two low region sounds in a superposed manner as shown in FIG. 6(C) in the external space, the two low region sounds having the characteristics shown in FIGS. 6(A) and (B) emitted by two Helmholtz resonant systems having different resonant frequencies and constituted by two open ducts 15, 16 of different lengths and two spatial portions V11, V12 of different volumes (see, for example, a speaker system 501X, manufactured by BOSE Co., USA).

Since this system superposes in the external space the two low sound regions emitted by the two Helmholtz resonant systems of different resonant frequencies, as described above, its high region attenuation characteristic is excellent. However, if the ratio in resonant frequency of the two resonant systems is set to a large value in order to expand a reproduced low sound region, its attenuation characteristic will change as shown in FIG. 6(D); namely, it cannot virtually provide a flat characteristic.

The speaker system of FIG. 7 is constituted by a box 21 closed on all its sides, a partition wall 22 dividing the internal space of the box into two spatial portions V21 and V22, a pair of speakers 23 and 24 attached to the partition wall 22, and a duct 25 provided on the side wall of the box 21 for communicating the external space with one (V21) of the spatial portions V21, V22.

This speaker system is constructed such that right and left stereophonic channel signals are individually reproduced as sounds by the pair of speakers 23 and 24, the sounds are acoustically mixed within the box 21, a sound region other than a low sound region of a predetermined band width is attenuated by two resonant systems of different resonant frequencies and constituted by the two spatial portions V21 and V22 and duct 25 and the remaining low sound region is emitted into the external space (see, for example, Unexamined Japanese Patent publication No. Sho 55-52694).

The speaker system of FIG. 7 can reproduce a relatively wide band with a single aperture, but one of the spatial portions is closed, so that to reduce the reproduction limit frequency and to reproduce a low sound region having a flater characteristic and enough sound pressure are limited in connection with the volume and structure of the box.

SUMMARY OF THE INVENTION

It is an object of the present invention to provide a low sound region reproducing speaker system which eliminates the prior art drawbacks, lowers the reproduction limit frequency and is capable of reproducing a low sound region of a flat characteristic even if a box is used having the same volume as the conventional speaker system.

(c) Means for Solving the Problems

The present invention provides a low sound region reproducing speaker system comprising a box closed on all its sides, a partition separating the internal space of the box into two spatial portions, a pair of speakers attached to the partition wall, an aperture formed in the side wall of the box though which one of the spatial portions communicates with the external space whereby right and left stereophonic channel signals are reproduced individually as sounds through the pair of speakers, the sounds are mixed acoustically within the box, a sound region other than a low sound region of the mixed sounds and of a predetermined band width is attenuated by two resonant systems defined by the two spatial portions and the aperture and different in resonant frequency and only the low sound region is emitted into the external space, characterized in that the partition wall has therein a communication hole for communicating the two spatial portions therethrough with each other.

The communication hole is preferably provided between the pair of speakers provided on the partition wall.

The two spatial portions defined by the partition wall are different in volume and the two spatial portions communicate through the hole with each other.

A sound absorbing material may be provided on the inner wall of at least one of the two spatial portions defined by the partition within the box.

An acoustic resistive material such as a net may be provided at the aperture.

Right and left stereophonic channel signals are individually reproduced as sounds by the pair of speakers, and the sounds are mixed acoustically within the single box.

The sound portions other than a low sound region of a given band width of the mixed sounds are attenuated by two resonant systems different in resonant frequency and constituted by the two spatial portions, communication hole, and aperture and the remaining low sound region is thus emitted into the external space.

At this time, a partial low sound region is emphasized and the output low region limit frequency is lowered by a so-called bass reflex operation due to the action of the communication hole and the spatial portion with no aperture open to the external space.

BRIEF DESCRIPTION OF THE DRAWINGS

FIG. 1 is a perspective view of a system with one side wall of its box being removed away, FIG. 2 is a cross sectional plan view of the embodiment of FIG. 1, FIG. 3 is an equivalent circuit diagram of the embodiment of FIG. 1.

FIG. 5 is a schematic of the conventional example, and FIGS. 6(A)–(D) are the characteristic diagram of the conventional example of FIG. 5.

DESCRIPTION OF THE EMBODIMENTS

Figure 1:
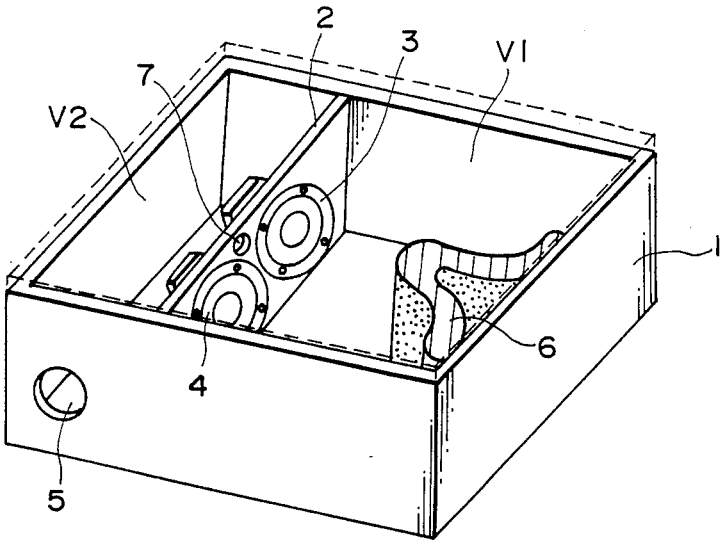
FIGS. 1–3 show an embodiment of the present invention.
Figure 2:
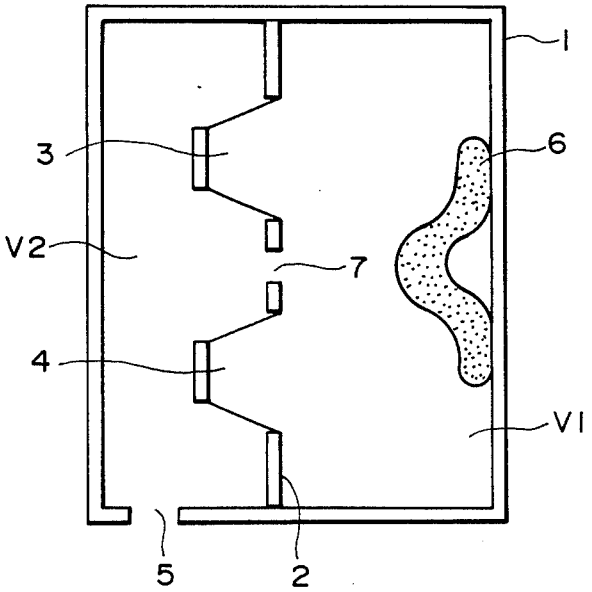

An embodiment of the present invention will now be described with reference to the drawings. FIG. 1 shows a low sound region reproducing speaker system in which the present device is carried out. In order to facilitate the view of the internal structure, the speaker system of FIG. 1 is shown in a perspective view with its one side being removed away. FIG. 2 is a cross-sectional plan view of the system.

In FIGS. 1 and 2, the box 1 is formed so as to be of a closed type with all the sides thereof being closed. The box 1 is divided by a partition 2 into two spatial portions of different volumes V1 and V2. Attached to the partition 2 are a pair of speakers 3 and 4 of a relatively small Q in the same orientation. The pair of speakers 3 and 4 are attached in the box such that the front sides of their vibrating plates are disposed within the spatial portion V1 of larger in volume than the spacial portion V2 and that their back side drive portions, etc., are disposed in the spatial portion V2. The right and left stereophonic channel signals are applied to one and the other of the speakers 3 and 4, respectively. Therefore, the right and left channel sounds reproduced individually by these speakers are mixed within the single box 1 on the basis of the operational principle to be described later.

Figure 4:
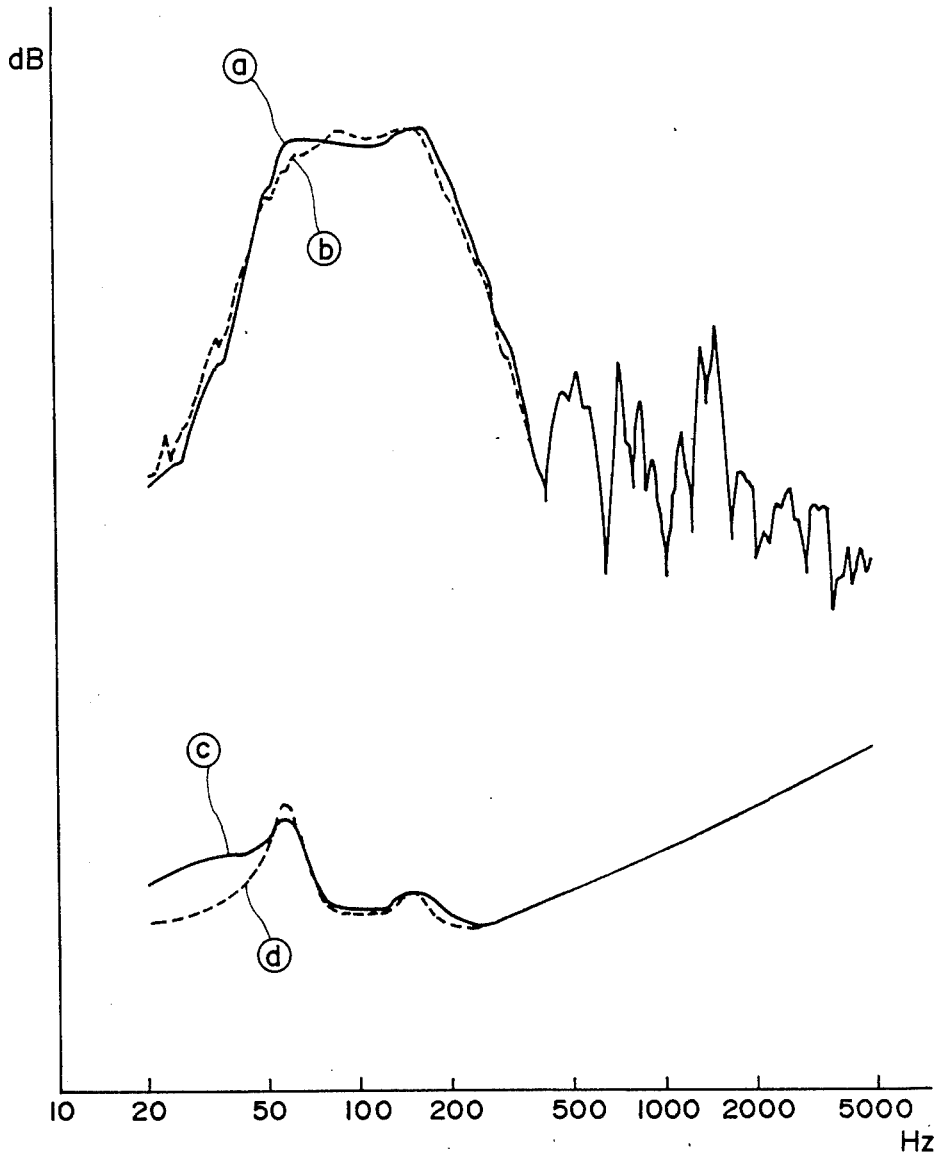
FIG. 4 illustrates the comparison in characteristic between the embodiment of FIG. 1 and the conventional example of FIG. 7.
Figure 5:
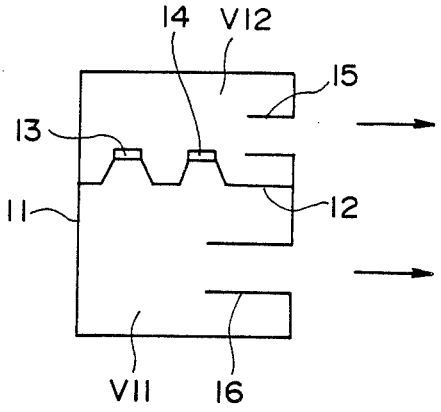
FIG. 5 and FIGS. 6(A)–(D) show the conventional example.
Figure 6A:
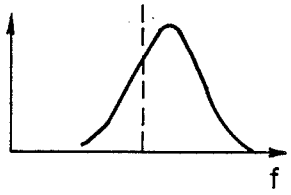
Figure 6B:
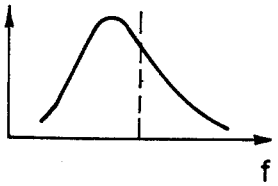
Figure 6C:
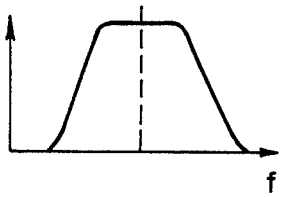
Figure 6D:
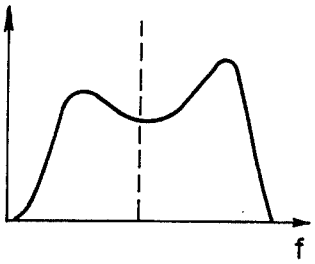

In the particular embodiment, the partition 2 to which the speakers 3 and 4 are attached has therein a communication hole 7 provided between the two speakers such that it establishes a communication between the two spatial portions V1 and V2. The box wall has on the spacial portion V2 side an aperture 5 through which only the spacial portion V2 communicates directly with the external space By this single simple aperture 5, the low frequency sound is emitted into the external space. Therefore, the low frequency region sound is driven by the speakers 3 and 4 of a small Q compared to the conventional speaker system shown in FIGS. 5 and 7 and requiring a relatively long duct. Thus only one aperture serves to provide a flat output characteristic of enough wide band as shown in FIG. 4ⓐ.

Preferably, the aperture 5 is covered with an acoustic resisting material (not shown) such as a net, cloth piece or sound absorber.

By provision of the acoustic resisting material at the opening 5, an unnecessary high sound region is further attenuated, and the shoulder characteristic and the acoustic output level can be adjusted.

The output band region can easily be changed by selecting the volumes V1, V2, V2/V1, and the $f_o$ and Q of the speakers 3 and 4, and adding the sound absorber material 6.

In the particular embodiment, the sound absorber material 6 is attached at a position opposite to the speakers 3 and 4 within the spatial portion V1 as shown in FIG. 1. The sound absorber material 6 takes the form of a roof such that the portion of the acoustic absorber material between the speakers 3 and 4 protrudes toward the speakers.

As just described above, according to the particular embodiment, the right and left stereophonic channel signals applied to one and the other of the speakers 3 and 4, respectively, are individually reproduced as sounds, which are then mixed in the spacial portions V1 and V2, respectively.

The mixed sounds are attenuated except for their low sound region of a given bandwidth by the two resonant systems different in resonant frequency and constituted by the two spatial portions V1 and V2, communication hole 7 and one aperture 5, and sounds in the remaining low sound region are emitted into the external space.

The low sound region waves of the given bandwidth emitted into the external space provide an improved low sound region shoulder characteristic and lowered output low sound region limit frequency as shown in FIG. 4ⓐ by a so-called bass reflex operation due to the action of the communication hole 7 and spatial portion V1 compared to a characteristic in FIG. 4ⓑ of a system with no communication aperture 7.

Figure 3:
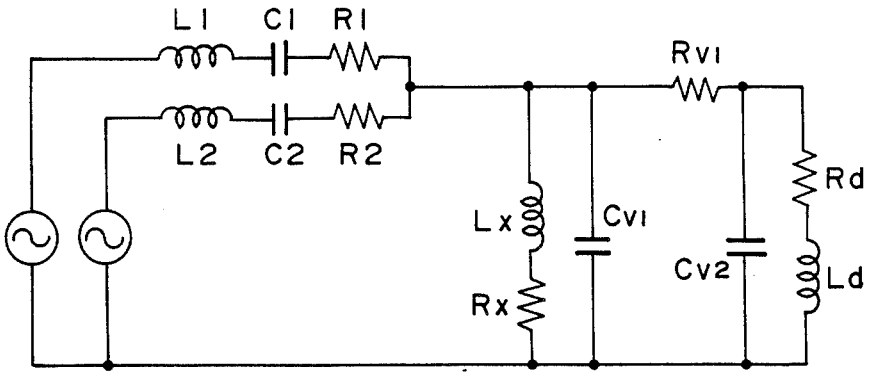

The above embodiment is represented schematically by an equivalent circuit shown in FIG. 3.

This equivalent circuit is on the presumption that the right and left stereophonic channel signals and the sound waves emitted from the spatial portion V1 through the communication hole 7 to the other spatial portion V2 are in phase in the low sound region.

In FIG. 3, L1, C2 and R1 represent one speaker 3 and L2, C2 and R2 represents the other speaker 4. $C_{v1}$ and $C_{v2}$ correspond to volumes V1 and V2, respectively. $R_d$ and $L_d$ correspond to air resistance and air weight at the aperture 5, respectively. $R_{v1}$ corresponds to the acoustic resistance of the sound absorber material 6, etc., attached in the volume V1. $R_x$ and $L_x$ correspond to air resistance and air weight, respectively, in the communication hole 7.

As will be seen from the equivalent circuit, the synthetic electrical impedance provides an output characteristic (FIG. 4ⓐ which has three peaks at the corresponding frequencies and which is greatly attenuated except for the band area between the peak at the lowest peak frequency and the peak at the highest peak frequency .

Therefore, by changing these three resonant frequencies, the output band is changed. In addition, by changing the Q of the speakers 3 and 4, and the acoustic resistance $R_{v1}$ by the sound absorber material 6, etc., the output characteristic can be flattened and the shoulder characteristic can be adjusted.

Figure 7:
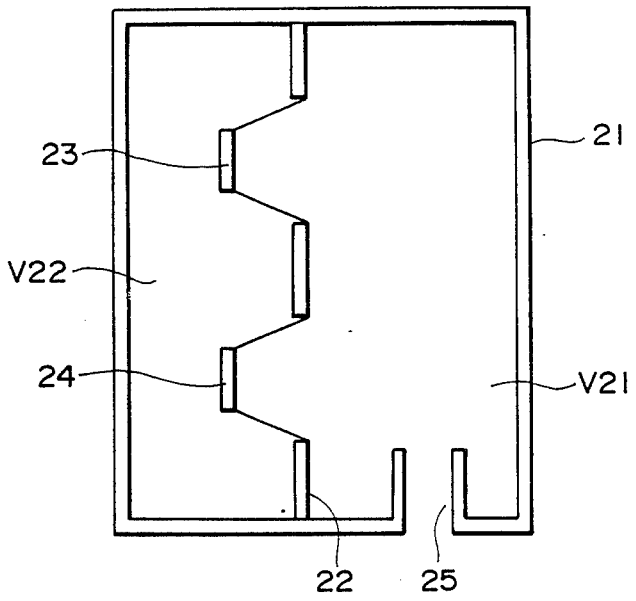
FIG. 7 is a schematic of another conventional example.

FIG. 4 illustrates the comparison in characteristic between the speaker system with the communication hole 7 in the particular embodiment of FIGS. 1 and 2, and the conventional speaker system with no communication hole shown in FIG. 7.

In FIG. 4, ⓐ the reproduction frequency characteristic of the speaker system in the particular embodiment ⓑ a similar characteristic of the conventional speaker system.

ⓒ the impedance characteristic of the speaker system in the particular embodiment and ⓓ similar characteristic of the conventional speaker system.

In the particular embodiment, the resonant frequency of the resonant system constituted by the spatial portion V1 and the communication hole 7 is set to a value close to and lower than the lower one of the two frequencies corresponding to the two electrical impedance peaks of the conventional speaker system shown in FIG. 7. Therefore, the electrical impedance characteristic has another peak at this frequency, and as a result, the output low region limit shoulder characteristic is raised and the low region limit frequency is lowered, as shown in FIG. 4ⓐ.

The low sound region reproducing speaker system according to the present invention is constituted by a very small number of parts, and reproduces as sounds the right and left stereophonic channel signals, mixes these sounds, extracts only the low sound region as an output from the mixed signals, and lowers and expands the lower region reproduction limit frequency. Therefore, if the low sound region reproducing speaker system according to the present device is used, for example, as a 3D stereophonic reproducing speaker system, it provides a relatively wide low sound region of a flat output characteristic, so that a 3D stereophonic reproducing system is provided which is inexpensive as a whole and excellent in acoustic characteristic.

What is claimed is:

1. A low sound region reproducing speaker system comprising a box closed on all its sides and having at least one sidewall, a partition wall separating the internal space of the box into two spatial portions, a pair of speakers attached to the partition wall where one of the speakers is responsive to a right stereo-phonic channel signal and the other speaker is responsive to a left stereo-phonic channel signal, one of said spatial portions having no aperture open to space external to the box and an aperture being formed in said one side wall of the box through which the other of the spatial portions communicates with the space external to the box whereby right and left stereo-phonic channel signals are reproduced individually as sounds through the pair of speakers, the sounds are mixed acoustically within the box, a sound region other than a low sound region of the mixed sounds and of a predetermined band width is attenuated by two resonant systems defined by the two spatial portions and the aperture and different in resonant frequency and only the low sound region is emitted into the external space, characterized in that the partition wall has therein a communication hole for communicating the two spatial portions therethrough with each other so that a bass reflex operation is performed by the acoustic action of the communication hole and the spatial portion with no aperture open to the external space.

2. A low sound region reproducing speaker system according to claim 1, wherein the communication hole is provided between the pair of speakers provided on the partition wall.

3. A low sound region reproducing speaker system according to claim 1, wherein the two spatial portions defined by the partition wall within the box are different in volume and that the two spatial portions communicate through the hole with each other.

4. A low sound region reproducing speaker system according to claim 1, including a sound absorbing material provided on the inner wall of at least one of the two spatial portions defined by the partition within the box.

5. A low sound region reproducing speaker system according to claim 1, including an acoustic resistive material such as a net provided at the aperture.

* * * * *